US005704065A

United States Patent [19]

Feuerhake

[11] Patent Number: 5,704,065

[45] Date of Patent: Jan. 6, 1998

[54] GOLF GLOVES WITH INDICIA

[75] Inventor: Frederick W. Feuerhake, Weston, Conn.

[73] Assignee: Bost Enterprises, Inc., Westport, Conn.

[21] Appl. No.: 620,507

[22] Filed: Mar. 22, 1996

[51] Int. Cl.[6] ..... A41D 19/00

[52] U.S. Cl. ..... 2/161.2

[58] Field of Search ..... 2/161.1, 161.2, 2/161.3, 161.4, 159; 473/205

[56] References Cited

U.S. PATENT DOCUMENTS

| | | | |
|---|---|---|---|
| D. 362,105 | 9/1995 | Malloy et al. | D2/619 |
| 889,397 | 6/1908 | O'Shaugnessy | 2/161.2 |
| 3,255,462 | 6/1966 | Antonius | 2/161 |
| 3,278,944 | 10/1966 | Gowers | 2/159 |
| 3,348,238 | 10/1967 | Hydock | 2/161.2 |
| 3,648,292 | 3/1972 | Strickler | 2/161 |
| 3,848,874 | 11/1974 | Elkins, Jr. | 2/161.2 |
| 4,000,903 | 1/1977 | Swanson | 273/166 |
| 4,488,726 | 12/1984 | Murray | 273/183 |
| 4,665,565 | 5/1987 | Odom | 2/161.2 |
| 4,962,547 | 10/1990 | Minnick | 2/161.4 |
| 5,094,452 | 3/1992 | Hennigan | 273/32 |
| 5,184,353 | 2/1993 | Goldwitz | 2/161.4 |
| 5,184,815 | 2/1993 | Maddox | 2/161.1 |
| 5,232,225 | 8/1993 | Snyder | 2/161.3 |
| 5,462,280 | 10/1995 | Dickerson | 2/161.2 |
| 5,542,126 | 8/1996 | Harvanek | 2/161.1 |

FOREIGN PATENT DOCUMENTS

| | | | |
|---|---|---|---|
| 958891 | 5/1964 | United Kingdom | 2/161.2 |

OTHER PUBLICATIONS

Ben Hogan, Ben Hogan's Five Lessons: The Modern Fundamentals of Golf, pp. 18–33 (1957), published by Golf Digest.

Packaging for "The Glove", The Leadbetter Collection, Golf Training Systems Inc. Date Unknown.

*Primary Examiner*—Michael A. Neas

*Attorney, Agent, or Firm*—David P. Gordon

[57] ABSTRACT

A pair of gloves for guiding a novice golfer includes a glove for the hand uppermost on the golf club and a glove for the hand lowermost on the golf club. On each glove, an arrowed indicium guides alignment of the club shaft to the body of the golfer, a knuckle indicium guides hand rotation, a palm side stripe guides club shaft positioning within each hand, and finger markers guide which fingers of each hand apply pressure to the club shaft. Preferably, the gloves are not identical mirror images, each glove having specialized indicia for either the lowermost hand on the golf club shaft or the uppermost hand on the golf club shaft. In addition, it is preferable that the indicia be applied to not have raised surfaces, so as to meet USGA requirements.

15 Claims, 4 Drawing Sheets

GOLF GLOVES WITH INDICIA

BACKGROUND OF THE INVENTION

1. Field of the Invention

This invention relates broadly to golf gloves. More particularly, this invention relates to golf gloves with indicia to assist a golfer in properly gripping a golf club in his hands and aligning the golf club with his body.

2. State of the Art

The sport of golf has become increasingly popular. One of the fundamentals of the game is learning to properly grip the golf club. A propel grip is one which correctly positions the golf club in the golfer's hands and orients the hands of the golfer to his body such that when the golfer swings the club to hit the ball, the golfer attains the desired result. Hogan, in *Five Lessons: The Modern Fundamentals of Golf* (1957), reveals a recommended club placement and hand orientation for a solid golf swing. Regarding the hand uppermost (the left hand on a right-handed golfer), with the fingers facing downward to receive the shaft, the shaft of the club should lie diagonally in the palm and extend across the joint of the forefinger closest the palm. Also regarding the hand uppermost, the V formed in the crook of the forefinger and thumb should point directly at the opposing eye. That is, if the golfer is right-handed, the hand uppermost is the left hand and the V should point to the golfer's right eye. Regarding the hand lowermost, the right hand for a right-handed golfer, with the fingers facing downward to receive the shaft, the shaft of the club should lie across the joints closest the palm of the four fingers. With the arms outstretched, the V formed in the crook of the forefinger and thumb of the hand lowermost, which is placed over the hand uppermost, should point directly at the chin of the golfer. Additionally, with the completed two hand grip, only the knuckles of the forefinger and middle-finger should be visible to the golfer when the golfer is set to swing and the club is aligned properly in the golfer's hands and with the golfer's body.

Many golfers wear a glove on the hand which grips the uppermost portion of a golf club to improve their grip and to keep the proper alignment during the placement and swing of a golf club. In the case of a right-handed player, the glove would usually be worn on the left hand, and vice versa for a left-handed player. It is well known in the art to design gloves for novice golfers which further assist by providing some indicia of a proper grip to the golfer. Sometimes two gloves are used in combination, although these gloves do not include indicia on both gloves. Several of these golf gloves provide visual, tactile or aural indicia to assist with aligning the club within the hands and orienting the hands with the golfer's body. For example, Australia Patent No. 262,491 to Gowers discloses a glove with visual indicia on the back of glove knuckles to indicate hand orientation around the shaft of the club. Three patches, one red, one amber, and one green, are situated on the back of the glove such that if the red or amber area is visible to the golfer, the golfer's hands are positioned incorrectly. Conversely, if only the green patch is visible, the golfer's hands are in the correct position with respect to knuckle rotation. However, rotating the knuckles correctly does not insure that the golf club shaft is properly positioned within the golfer's hands or that other necessary orientations of the golfer's hands are correct.

U.S. Pat. No. 5,184,353 to Goldwitz also shows visual indicia of varying sizes on the back knuckles of a golf glove to inform the golfer of the orientation of his hand uppermost on the golf club. In addition, Goldwitz includes palm markings to assist in club shaft placement. However, the knuckle and palm markings only partially assist the golfer in properly gripping the club shaft, as other recommended hand alignments are not addressed.

U.S. Pat. No. 5,462,280 to Dickerson discloses another manner of aligning the shaft in the golfer's hand. Dickerson discloses a pair of gloves. The glove for the hand uppermost on the golf club includes a diagonal stripe which is a guide for shaft placement and also includes a series of small hooks on the thumb of the glove. A second glove for the hand lowermost on the golf club includes a felt-like material on the thumb of the glove for engaging the hooks of the first glove. When the thumb portions of the glove are aligned, the hooks and felt engage. If the golfer's hands then move out of alignment, the hooks and felt disengage resulting in a tearing sound and aurally indicate to the golfer that his grip is incorrect. While Dickerson's invention does offer one manner of aligning the shaft within the hand of the golfer, it has shortcomings. First, only one of many necessary hand alignments is addressed. Second, the use of hooks and felt complicates the construction of the gloves.

None of the prior art satisfactorily and fully offers the necessary guidance for aligning a club within the hands of a golfer in accord with professional recommendations.

SUMMARY OF THE INVENTION

It is therefore an object of the invention to provide a golf glove which fully assists golfers in properly positioning a golf club in their hands.

It is another object of the invention to provide a golf glove which has several visual indicia for positioning a golf club in the hand of a golfer.

It is a further object of the invention to provide a pair of golf gloves which have different visual indicia for positioning a golf club in the hands of a golfer.

It is also object of the invention to provide a golf glove or pair of gloves which meet USGA requirements.

It is an additional object of the invention to provide a golf or pair of gloves which are easy to use.

In accord with these objects which will be discussed in detail below, the golf glove for the hand which grips the club uppermost includes several indicia for properly positioning a golf club in the hand of a golfer which grips the club uppermost. First, an arrowed indicium is located on or adjacent the thumb portion. This indicia permits the golfer to align his hand in accord with various recommendations by a number of professionals. By simply glancing at this indicium, the golfer can determine that his hand is correctly oriented to his body. Second, indicia are located on one or more knuckles or another portion of the backside of the glove uppermost to determine the proper amount of rotation for the hand uppermost on the club shaft. Third, a stripe extends diagonally along the palm and the palm side of the forefinger of the glove for positioning the club shaft in the hand uppermost. Fourth, markings on certain fingers serve as reminders as to which fingers of the hand uppermost on the club supply the pressure for gripping the club.

Preferably, a second glove for the hand which grips the club lowermost is also used. The second glove includes several additional indicia for properly positioning a golf club in a golfer's hands. First, a pointer indicium adjacent the thumb and forefinger crook of the glove provides feedback on the alignment of the hand lowermost to the hand uppermost. Second, indicia are located on one or more knuckles or other portion of the backside of the glove lowermost to assist in determining the proper amount of rotation for the hand lowermost on the club shaft. Third, a stripe is located along the palm side of the glove fingers for aligning the club shaft in the hand lowermost. Fourth, markings on certain fingers serve as reminders as to which fingers of the hand lowermost on the club supply the pressure for gripping the club.

It will be appreciated that when the hand uppermost on the club shaft is fit with the appropriate glove, the several indicia will fully indicate whether or not the hand uppermost is positioned according to a recommended position. Should the hand uppermost not be in the recommended position, the indicia will guide the glove wearer to the correct position. Likewise, indicia on the second glove will indicate whether or not the hand lowermost is positioned on the club shaft according to a recommended position and whether or not the two hands are positioned correctly in relation to one another; and the indicia will further assist in bringing both hands into the correct position should the hands not be positioned correctly.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
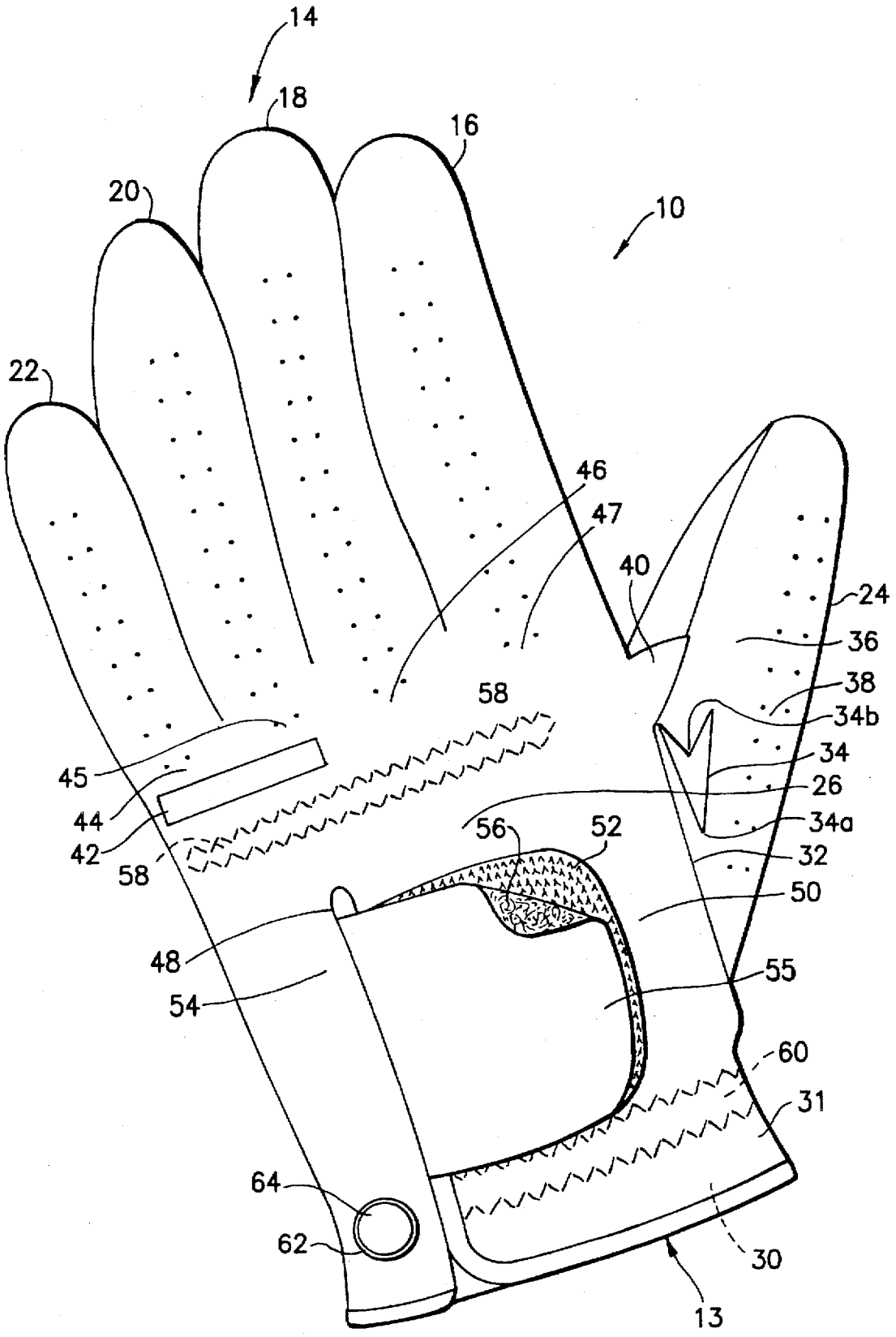
FIG. 1 is a back side view of the left hand glove for a right-handed golfer.
Figure 2:
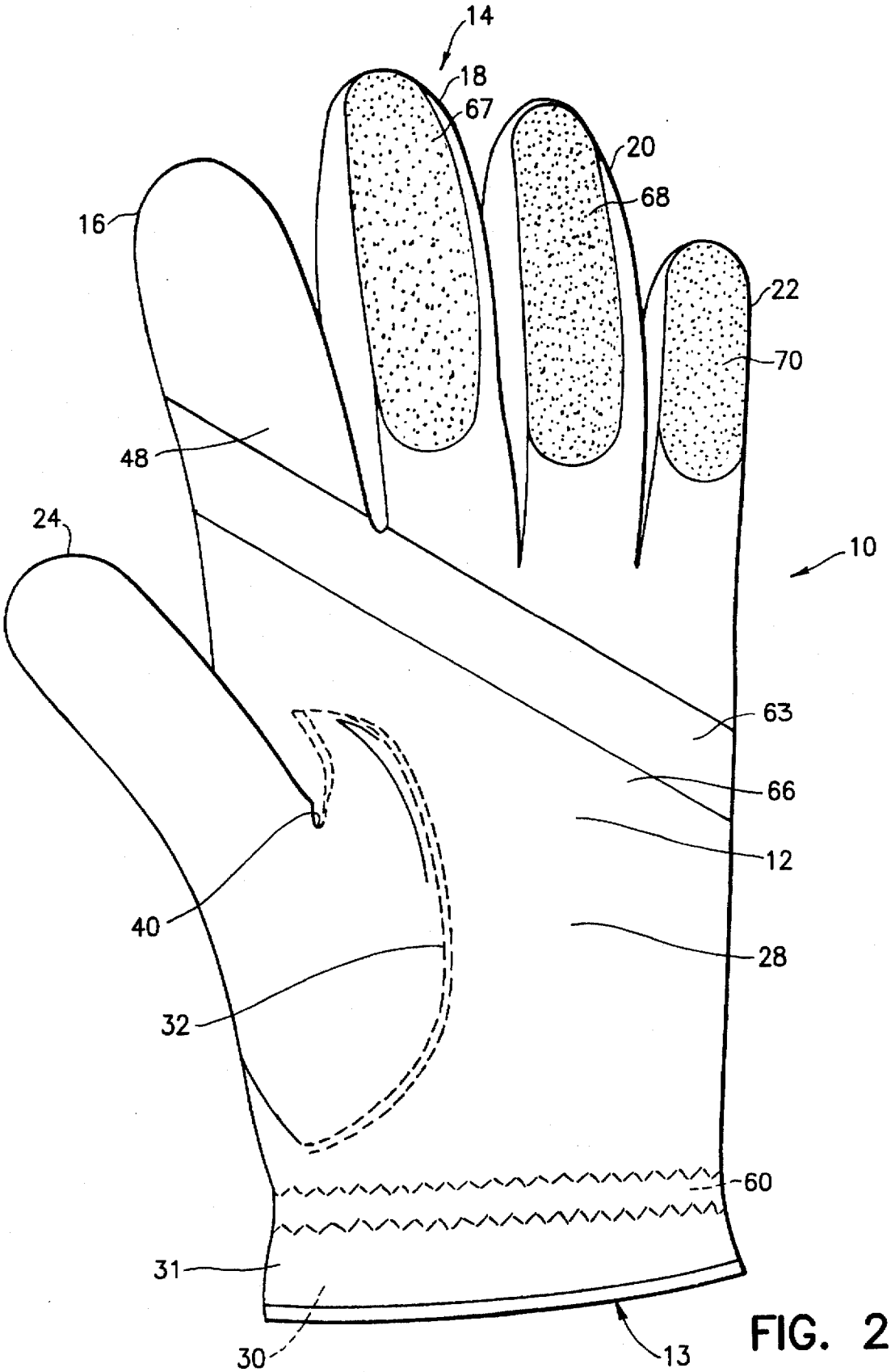
FIG. 2 is a palm side view of the left hand glove for a right-handed golfer.

Turning now to FIGS. 1 and 2, according to one embodiment of the invention, a left hand glove 10, for a right-handed golfer, includes a palm portion 12 having an open end 13, a closed finger portion 14 having an index finger 16, a middle finger 18, a ring finger 20, and a pinky 22, and a thumb 24. The back side of the glove is indicated at 26 and the palm side is indicated at 28. The glove also includes an inside indicated by 30 and an outside indicated by 31. The thumb 24 is fixed to the back 26 and palm 28 sides of the glove 10 by a seam 32. An arrow-shaped indicium 34 is located on the back side 36 of the thumb 24 between a lower knuckle area 38 of the thumb 24 and the seam 32; i.e., adjacent the crook 40 between the thumb 24 and the index finger 16. The arrow-shaped indicium 34 points toward the open end 13 of the glove 10 and is preferably arranged as an arrowhead with an aligned point 34*a* and an indent 34*b*.

The fingers 16, 18, 20, 22 join the palm portion 12 of the glove above the knuckles of the golfer's fingers closest to the palm. A knuckle indicium 42 is provided to the knuckles 44, 46 of the ring 20 and pinky 22 fingers.

The back side 26 of the glove 10 is split 48 at the open end 13. On the thumb side 50 of the split 48 a patch of Velcro hooks 52 is sewn to the back side 26 of the glove. Extending from the pinky side 54 of the split 48 a flange 55 having a patch of Velcro loops 56 is sewn. It will be appreciated that the two patches 52, 56 can be engaged to permit the glove 10 to fit snugly around a golfer's hand. A first elastic strip 58 is sewn into the inside 30 of the glove 10 on the backside 26 behind and along the knuckles 44, 45, 46, 47 of the fingers. A second elastic strip 60 is sewn into the inside 30 of the back 26 and palm 28 sides of the glove 10 adjacent the open end 13. On the back side 26 of the glove 10, over the second elastic strip 60 and on the pinky side 54 of the split 48, a receiving snap 62 is fixed and a golf ball marker 63 is snap fit in the receiving snap 62.

Referring now to FIG. 2, on the palm side 28 of the glove 10, a stripe indicium 64 extends diagonally from an upper portion 66 of the palm 12 of the glove 10 on the pinky side to the third phalange 48 on the index finger 16. Additionally, on the palm side 28 of the glove 10, the middle finger 18, the ring finger 20, and the pinky finger 22, each have left hand pressure gripping indicia, 67, 68, 70, respectively.

Figure 3:
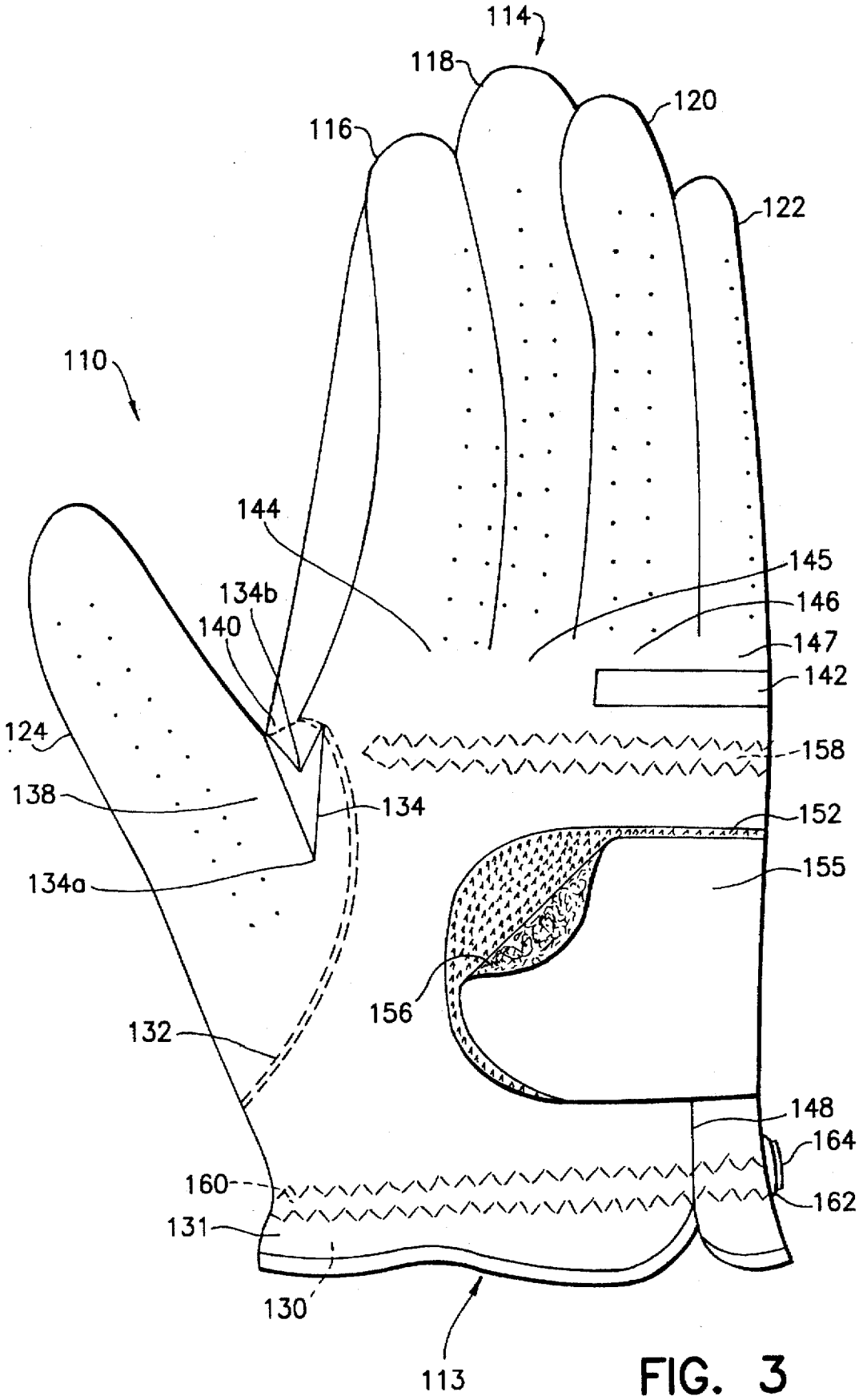
FIG. 3 is a back side view of the right hand glove for a right-handed golfer.
Figure 4:
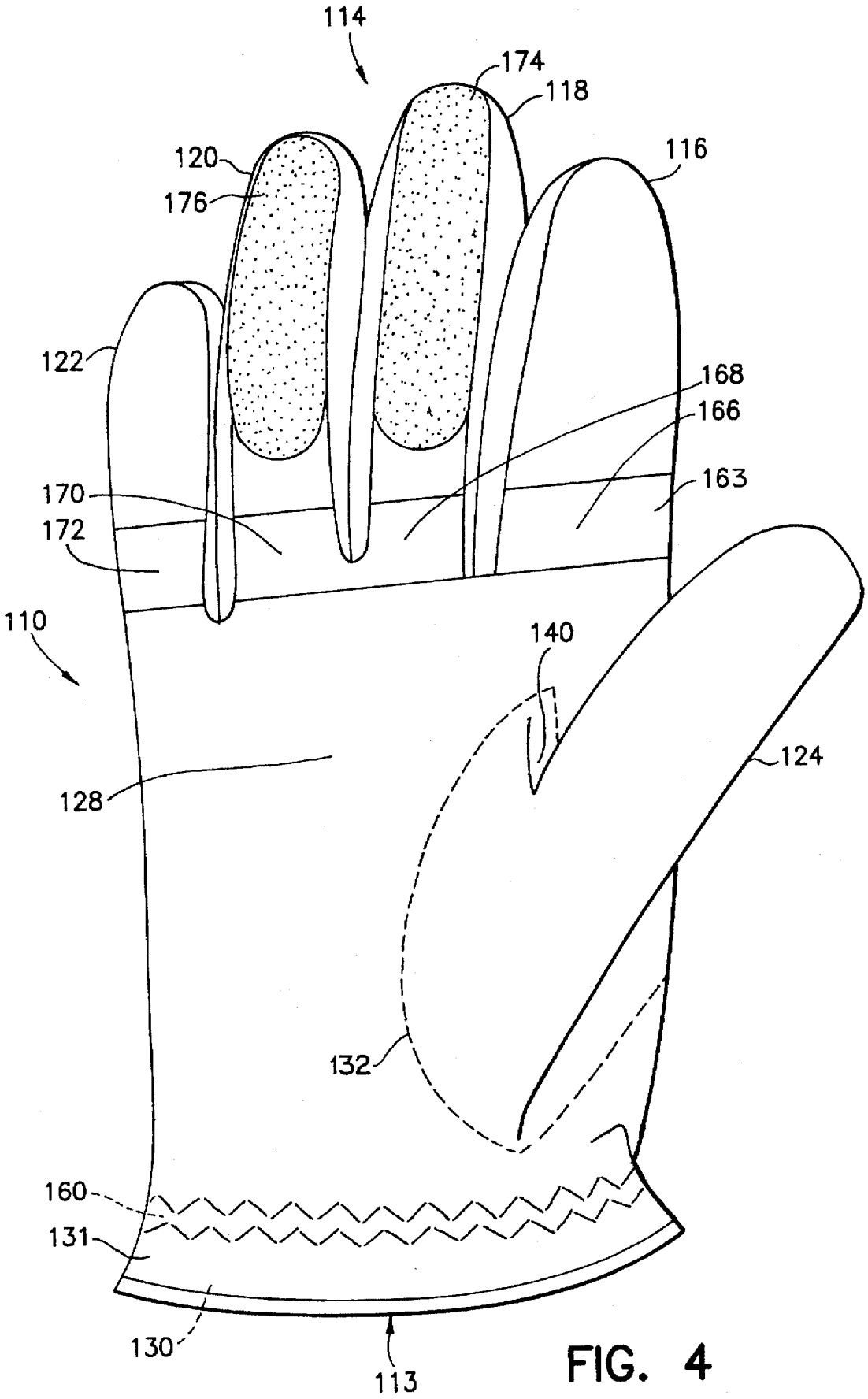
FIG. 4 is a palm side view of the right hand glove for a right-handed golfer.

Turning now to FIGS. 3 and 4, a right hand glove 110, for a right-handed golfer, includes a palm portion 112 having an open end 113, a closed finger portion 114 having an index finger 116, a middle finger 118, a ring finger 120, and a pinky 122, and a thumb 124. The back side of the glove is indicated at 126 and the palm side is indicated at 128. The glove also includes an inside indicated by 130 and an outside indicated by 131. The thumb 124 is fixed to the back 126 and palm 128 sides of the glove 110 by a seam 132. An arrow-shaped indicium 134 is located on the back side 136 of the thumb 124 between a lower knuckle area 138 of the thumb 124 and the seam 132; i.e., adjacent the crook 140 between the thumb 124 and the index finger 116. The arrow-shaped indicium 134 points toward the open end 113 of the glove 110 and is preferably arranged as an arrowhead with an aligned point 134*a* and an indent 134*b*.

The fingers 116, 118, 120, 122 join the palm portion 112 of the glove 110 above the knuckles of the golfer's fingers closest to the palm. A knuckle indicium 142 is provided to the knuckles 144, 145 of the ring 120 and pinky 122 fingers.

The back side 126 of the glove 110 is split 148 at the open end 113. On the thumb side 150 of the split 148 a patch of Velcro hooks 152 is sewn to the back side 126. Extending from the pinky side 154 of the split 148 a flange 155 having a patch of Velcro loops 156 is sewn. It will be appreciated that the two patches 152, 156 can be engaged to permit the glove 110 to fit snugly around a golfer's hand. A first elastic strip 158 is sewn into the inside 130 of the back 126 and palm 128 sides of the glove 110 on the backside 126 behind and along the knuckles 144, 145, 146, 147 of the fingers. A second elastic strip 160 is sewn into the inside 130 of the glove 110 adjacent the open end 113. On the back side 126 of the glove, over the second elastic strip 160 and on the pinky side 154 of the split 148, a receiving snap 162 is fixed and a golf ball marker 163 is snap fit into the receiving snap 162.

Referring now to FIG. 4, on the palm side 128 of the glove 110, a stripe indicium 164 extends laterally across the third phalange 166, 168, 170, 172 of each finger 116, 118, 120, 122. Additionally, on the palm side 128 of the glove 110, the middle finger 118 and the ring finger 120 each have left hand pressure gripping indicia 174, 176, respectively.

Preferably, each of the indicium to each glove is printed, stitched flat or applied in another manner so that the surface of the glove is not raised by the indicia. Application of the indicia in this method, without raised surfaces, allows the glove to meet USGA (United States Golf Association) requirements.

Regarding the left hand glove, with the described preferred embodiment many advantages are attained. First, the arrow-shaped indicium provides guidance for thumb placement of the hand uppermost on the club and guides alignment of the club shaft to the body of the golfer. Second, the rectangular-shaped indicium provides guidance for hand rotation of the hand uppermost on the club. Third, the palm side stripe provides guidance for club shaft placement in the hand uppermost on the club. Fourth, the gripping indicia remind a golfer which fingers on the left hand supply the pressure in gripping the club. Regarding the right hand glove, the arrow-shaped indicium provides guidance for thumb placement of the hand lowermost on the club. The rectangular-shaped indicium provides guidance for hand rotation of the hand lowermost on the club. The palm stripe provides guidance for club shaft placement in the hand lowermost on the club. Finally, the right hand gripping indicia remind a golfer which fingers on the right hand supply the pressure for gripping the club.

For example, according to one recommended orientation of the hands, for a right-handed player, the V formed at the crook of the forefinger and thumb of the left hand should point directly at the right eye. Others have recommended that the V formed at the crook point at the chin or right shoulder. Regardless of the advice with which the novice golfer seeks to follow, for a right-handed golfer, the arrow-shaped indicium permits proper alignment by directing the point of the arrow toward the alignment target. By simply glancing at this indicium, the golfer can determine that his left hand is correctly positioned. Similarly, for the right hand of a right-handed player, some advise that the V formed at the crook of the right hand should point toward the chin. Should the golfer choose to follow this recommendation or any other, alignment with the chin or other target is easily made through use of the arrow-shaped indicium on the right hand glove. Absent the side-by-side assistance of a golf pro, the two gloves together offer unprecedented guidance for learning to correctly grip a golf club.

In addition, regarding the left hand glove, and likewise with the right hand glove, the knuckle indicium will be visible to the golfer if the hand is not rotated sufficiently. The knuckle indicium moves out of the golfer's visibility once the hand is sufficiently rotated. Furthermore, the palm stripe of the left hand glove guides the golfer to correctly place the shaft of the golf club in his left hand, such that the shaft extends from the pad of the palm to the third phalange of the forefinger. The palm stripe of the right hand glove guides the golfer to correctly place the shaft of the golf club in his right hand, such that the shaft of the club lies across the third phalange of the fingers of the right hand.

Finally, the gripping indicia on the left hand glove indicate to the golfer that the middle, ring, and pinky fingers are used by the left hand to apply the pressure to the golf club. The gripping indicia on the right hand glove indicate to the golfer that the middle and ring fingers apply the pressure to the golf club.

As a result of all the indicia, the two gloves together fully guide the golfer in positioning the golf club within his hands and orienting both hands so that when the golfer swings the golf club at a golf ball, the golfer attains the desired outcome.

There have been described and illustrated herein an embodiment of a pair of golf gloves. While particular embodiments of the invention have been described, it is not intended that the invention be limited thereto, as it is intended that the invention be as broad in scope as the art will allow and that the specification be read likewise. Thus, while particular shapes for the several indicia have been disclosed, it will be appreciated that other shaped indicia, and also indicia of a variety of colors, can be used as well. For example, while arrow-shaped indicia have been disclosed for aligning the thumbs, other shapes having a directional meaning, such as lines, star points, and crosses, can also be used. Similarly, rectangular-shaped indicia have been disclosed on the knuckles of the gloves, other indicia for determining hand rotation can also be used, such as circles, squares, or triangles, or differently colored patches on the glove backside, or similar or different indicia over different knuckles or other portions of the backside of the glove than those disclosed in the preferred embodiment. Furthermore, while the invention has been disclosed for use by a right-handed golfer, it will be understood that such gloves can easily be configured for use by a left-handed golfer. The right hand glove for the left-handed golfer would have all the attributes disclosed for the left hand glove of a right-handed golfer, only in a mirrored configuration. Likewise, the left hand glove for the left-handed golfer would have all the attributes disclosed for the right hand of a left-handed golfer, only in a mirrored configuration. In addition, while it is preferred that the indicia be applied so that no raised indicia are present on the glove, it is understood that raised indicia can be used. It will therefore be appreciated by those skilled in the art that yet other modifications could be made to the provided invention without deviating from its spirit and scope as so claimed.

We claim:

1. A golf glove for use by a golfer on the hand which grips a golf club shaft uppermost, comprising:

a) a plurality of fingers provided with gripping indicia;

b) a thumb;

c) a palm portion having a palm side and a back side and an open end; and d) a pointing indicium, wherein a first finger of said plurality of fingers is located nearest said thumb, a crook being formed therebetween, wherein said pointing indicium is located on a back side of said golf glove substantially adjacent said crook such that when said glove is worn by the golfer and the golf club shaft is gripped, said pointing indicium is adapted to point to a target area on the body of the golfer wearing said glove and enables the golfer by glancing at said pointing indicium to determine whether the hand uppermost on the club shaft is correctly positioned, and if not, to correct the position of the hand uppermost, and a second, third, and fourth finger of said plurality of fingers include said finger gripping indicia which indicate that said second, third, and fourth fingers of said plurality of fingers are used to grid the golf club shaft with greater pressure than said first finger.

2. A golf glove according to claim 1, wherein:

said pointing indicium is located on said thumb.

3. A golf glove according to claim 1, wherein:

said back side of said palm portion includes a knuckle area having a knuckle indicium adjacent at least two of said plurality of fingers, wherein when said golf glove is worn by the golfer said knuckle indicium enables the golfer to determine that the hand uppermost on the golf club shaft is correctly rotated.

4. A golf glove according to claim 1, wherein:

said palm side of said palm portion and said first finger of said plurality of fingers includes a shaft location indicium.

5. A golf glove according to claim 1, wherein:

said pointing indicium is arrow-shaped and points generally toward said open end.

6. A golf glove for use by a golfer on the hand which grips a golf club shaft lowermost, comprising:

a) a plurality of fingers including finger gripping indicia;

b) a thumb;

c) a palm portion having a palm side and a back side and an open end; and d) a pointing indicium, wherein a first finger of said plurality of fingers is located nearest said thumb, a crook being formed therebetween, wherein said pointing indicium is located on a back side of said golf glove substantially adjacent said crook such that when said glove is worn by the golfer and the golf club shaft is gripped, said pointing indicium is adapted to point to a target area on the body of the golfer wearing said glove and enables the golfer by glancing at said pointing indicium to determine whether the hand lowermost on the club shaft is correctly positioned, and if not, to correct the position of the hand lowermost, and a second and third finger of said plurality of fingers include said finger gripping indicia which indicate that said second and third fingers of said plurality fingers are used to grip the golf club shaft with greater pressure than said first finger.

7. A golf glove according to claim 6, wherein:

said pointing indicium is located on said thumb.

8. A golf glove according to claim 6, wherein:

said back side of said palm portion includes an area having a knuckle indicium adjacent at least two of said plurality of fingers, wherein when said golf glove is worn by the golfer said knuckle indicium enables the golfer to determine that the hand lowermost on the golf club shaft is correctly rotated.

9. A golf glove according to claim 6, wherein:

said palm side of said palm portion and said first finger of said plurality of fingers includes a shaft location indicium.

10. A golf glove according to claim 6, wherein:

said pointing indicium is arrow-shaped and points generally toward said open end.

11. A pair of golf gloves, comprising:

(a) an uppermost golf glove for use by a golfer on the hand which grips a golf club shaft uppermost, having (i) a plurality of uppermost fingers provided with first finger gripping indicia, (ii) an uppermost thumb, (iii) a first palm portion having a palm side and a back side and a first open end, and (iv) a first pointing indicium; and (b) a lowermost golf glove for use by a golfer on the hand which grips a golf club shaft lowermost, having (i) a plurality of lowermost fingers provided with second finger gripping indicia, (ii) a lowermost thumb, (iii) a second palm portion having a palm side and a back side and a second open end, and (iv) a second arrow-shaped pointing indicium pointing generally in the direction of said second open end, wherein a first uppermost finger of said plurality of uppermost fingers is located nearest said uppermost thumb, a first crook being formed therebetween, wherein said first pointing indicium is located on a back side of said golf glove substantially at said first crook such that when said uppermost glove is worn by the golfer and the golf club shaft is gripped, said first pointing indicium is adapted to point to a target area on the body of the golfer wearing said uppermost glove and enables the golfer by glancing at said first pointing indicium to determine whether the hand uppermost on the club shaft is correctly positioned, and if not, to correct the position of the hand uppermost, a second, third, and fourth finger of said plurality of uppermost fingers include said first finger gripping indicia which indicate that said second, third, and fourth fingers of said plurality of uppermost fingers are used to grip the golf club shaft with greater pressure than said first finger of said plurality of uppermost fingers, a first lowermost finger of said plurality of lowermost fingers is located nearest said lowermost thumb, a second crook being formed therebetween, wherein said second pointing indicium is located on a back side of said lowermost glove substantially adjacent said second crook such that when said lowermost glove is worn by the golfer and the golf club shaft is gripped, said second pointing indicium is adapted to point to a target area on the body of the golfer wearing said lowermost glove and enables the golfer by glancing at said second pointing indicium to determine whether the hand lowermost on the club shaft is correctly positioned, and if not, to correct the position of the hand lowermost, and a second and third finger of said plurality of lowermost fingers include said second finger gripping indicia which indicate that said second and third fingers of said plurality of lowermost fingers are used to grip the golf club shaft with greater pressure than said first finger of said plurality of lowermost fingers.

12. A pair of golf gloves according to claim 11, wherein:

said first pointing indicium is located on said uppermost thumb and said second pointing indicium is located on said lowermost thumb.

13. A pair of golf gloves according to claim 11, wherein:

said back side of said first palm portion includes a first knuckle area having a first knuckle indicium adjacent at least two of said plurality of uppermost fingers, and said back side of said second palm portion includes a second knuckle area having a second knuckle indicium adjacent at least two of said plurality of lowermost fingers, wherein when said uppermost golf glove is worn by the golfer said first knuckle indicium enables the golfer to determine that the hand uppermost is correctly rotated and wherein when said lowermost golf glove is worn by the golfer said second knuckle indicium enables the golfer to determine that the hand lowermost is correctly rotated.

14. A pair of golf gloves according to claim 11, wherein:

said palm side of said first palm portion and said first finger of said plurality of uppermost fingers includes a first shaft location indicium and said palm side of said second palm portion and said first finger of said plurality of lowermost fingers includes a second shaft location indicium.

15. A golf glove according to claim 11, wherein:

said first and second pointing indicia are each arrow-shaped, and said first pointing indicium points generally in the direction of said first open end and said second pointing indicium points generally in the direction of said second open end.

* * * * *